US010526944B2

(12) United States Patent
Imada

(10) Patent No.: US 10,526,944 B2
(45) Date of Patent: Jan. 7, 2020

(54) FILTER REGENERATION DEVICE, FILTER PLUGGING DETECTION DEVICE, EXHAUST GAS TREATMENT APPARATUS, AND FILTER PLUGGING DETERMINATION METHOD

(71) Applicant: FUJITSU LIMITED, Kawasaki-shi, Kanagawa (JP)

(72) Inventor: Tadahiro Imada, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 165 days.

(21) Appl. No.: 15/676,935

(22) Filed: Aug. 14, 2017

(65) Prior Publication Data

US 2018/0087421 A1 Mar. 29, 2018

(30) Foreign Application Priority Data

Sep. 28, 2016 (JP) ..... 2016-190288

(51) Int. Cl.

*F01N 3/028* (2006.01)
*F01N 9/00* (2006.01)
*F01N 11/00* (2006.01)

(52) U.S. Cl.

CPC ..... *F01N 3/028* (2013.01); *F01N 9/002* (2013.01); *F01N 11/002* (2013.01); *F01N 2370/22* (2013.01)

(58) Field of Classification Search

CPC .. F01N 11/002; F01N 2370/22; F01N 3/0222; F01N 3/028; F01N 9/002

See application file for complete search history.

(56) References Cited

U.S. PATENT DOCUMENTS 5,423,180 A * 6/1995 Nobue ..... F01N 3/028 60/274
7,041,266 B1 * 5/2006 Angier ..... D01F 9/08 423/345

(Continued)

FOREIGN PATENT DOCUMENTS

EP 0469237 A1 2/1992
EP 0506083 A1 9/1992

(Continued)

OTHER PUBLICATIONS

Machine English Translation of JP05234670 (Year: 1993).*

(Continued)

*Primary Examiner* — Audrey K Bradley
*Assistant Examiner* — Anthony Ayala Delgado
(74) *Attorney, Agent, or Firm* — Fujitsu Patent Center

(57) ABSTRACT

A filter regeneration device includes a microwave radiator configured to radiate a microwave and disposed to be oriented in a direction toward a ceramic filter configured to purify exhaust gas of an internal combustion engine, the ceramic filter being disposed in a cylindrical portion of a metallic case having the cylindrical portion and having a protruding portion protruding toward an outside of the cylindrical portion of the metallic case, the microwave radiator being disposed inside the protruding portion, and a microwave generator configured to generate the microwave radiated from the microwave radiator toward the ceramic filter.

12 Claims, 9 Drawing Sheets

(56) References Cited

U.S. PATENT DOCUMENTS

| | | | | |
|---|---|---|---|---|
| 2002/0069756 | A1* | 6/2002 | Mako | B01D 46/0063 95/148 |
| 2010/0050619 | A1* | 3/2010 | Colvin | F24D 13/00 60/311 |
| 2010/0212299 | A1* | 8/2010 | George | F01N 9/002 60/287 |
| 2015/0089924 | A1 | 4/2015 | Ogawa et al. | |
| 2018/0182879 | A1* | 6/2018 | Ren | H01L 21/246 |

FOREIGN PATENT DOCUMENTS

| | | | |
|---|---|---|---|
| JP | 4-183914 | | 6/1992 |
| JP | 4-295121 | | 10/1992 |
| JP | 4-298623 | | 10/1992 |
| JP | 05234670 | A * | 9/1993 |
| JP | 8-109817 | | 4/1996 |
| JP | 2009-036199 | | 2/2009 |
| JP | 2011-252387 | | 12/2011 |
| WO | 2009/008525 | A1 | 1/2009 |
| WO | 2013-161423 | | 10/2013 |

OTHER PUBLICATIONS

EESR—The Extended European Search Report dated Dec. 1, 2017 issued with respect to the corresponding European Patent Application No. 17185009.2.

* cited by examiner

FILTER REGENERATION DEVICE, FILTER PLUGGING DETECTION DEVICE, EXHAUST GAS TREATMENT APPARATUS, AND FILTER PLUGGING DETERMINATION METHOD

CROSS-REFERENCE TO RELATED APPLICATIONS

This application is based upon and claims the benefit of priority of the prior Japanese Patent Application No. 2016-190288, filed on Sep. 28, 2016, the entire contents of which are incorporated herein by reference.

FIELD

The disclosures discussed herein relate to a filter regeneration device, a filter plugging detection device, an exhaust gas treatment apparatus, and a filter plugging determination method.

BACKGROUND

In the related art, an exhaust gas purification apparatus for an internal combustion engine that burns and removes particulate matter including carbon microparticles discharged into an exhaust passage of the internal combustion engine by a single mode microwave particulate combustion apparatus has been studied. The single mode microwave particulate combustion apparatus includes a microwave generator configured to oscillate microwaves, a microwave transmitter configured to transmit the microwaves oscillated from the microwave generator into the exhaust passage, and a standing wave generating space part provided downstream of a connecting portion with the microwave transmitter.

The standing wave generating space part is configured to include an introducing port on one end and configured to pass an exhaust gas together with the microwave, a reflecting board on the other end and configured to reflect the microwave in a direction opposite to an exhaust flow direction, and a particulate deposition part configured to allow the particulate matter in the exhaust gas to deposit so that the deposited particulate matter is heated and burned by microwave energy.

Further, an isolator is disposed in the microwave transmitter configured to transmit the microwave generated in the microwave generator (see, e.g., Patent Document 1).

RELATED-ART DOCUMENT

Patent Document

Patent Document 1: Japanese Laid-open Patent Publication No. 2011-252387

As described above, the related-art exhaust purification device for an internal combustion engine includes a microwave transmitter (waveguide) and a standing wave generating space part (resonance part) provided in the exhaust passage, and further includes a waveguide with an isolator.

However, when a waveguide is used, a resonance part and an isolator are also required, which complicates the structure.

SUMMARY

According to an aspect of an embodiment, a filter regeneration device includes a microwave radiator configured to radiate a microwave and disposed to be oriented in a direction toward a ceramic filter configured to purify exhaust gas of an internal combustion engine, the ceramic filter being disposed in a cylindrical portion of a metallic case having the cylindrical portion and having a protruding portion protruding toward an outside of the cylindrical portion of the metallic case, the microwave radiator being disposed inside the protruding portion; and a microwave generator configured to generate the microwave radiated from the microwave radiator toward the ceramic filter.

The object and advantages of the invention will be realized and attained by means of the elements and combinations particularly pointed out in the appended claims.

It is to be understood that both the foregoing general description and the following detailed description are exemplary and explanatory and are not restrictive of the invention, as claimed.

DESCRIPTION OF EMBODIMENTS

The following describes embodiments to which a filter regeneration device, a filter plugging detection device, an exhaust gas treatment apparatus, and a filter plugging determination method of the present invention are applied.

EMBODIMENTS

Figure 1:
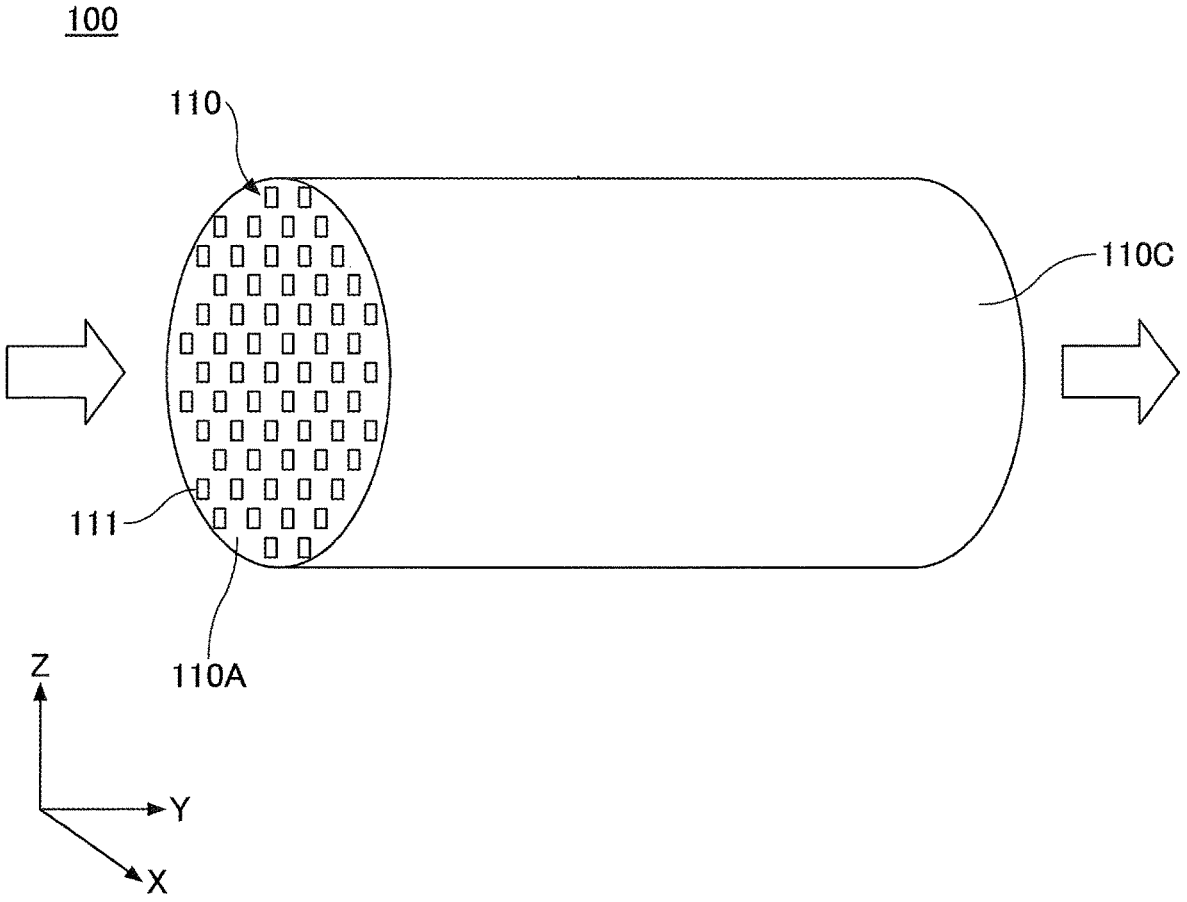
FIG. 1 is a diagram illustrating a filter 110 included in an exhaust gas treatment apparatus according to a first embodiment.
Figure 2:
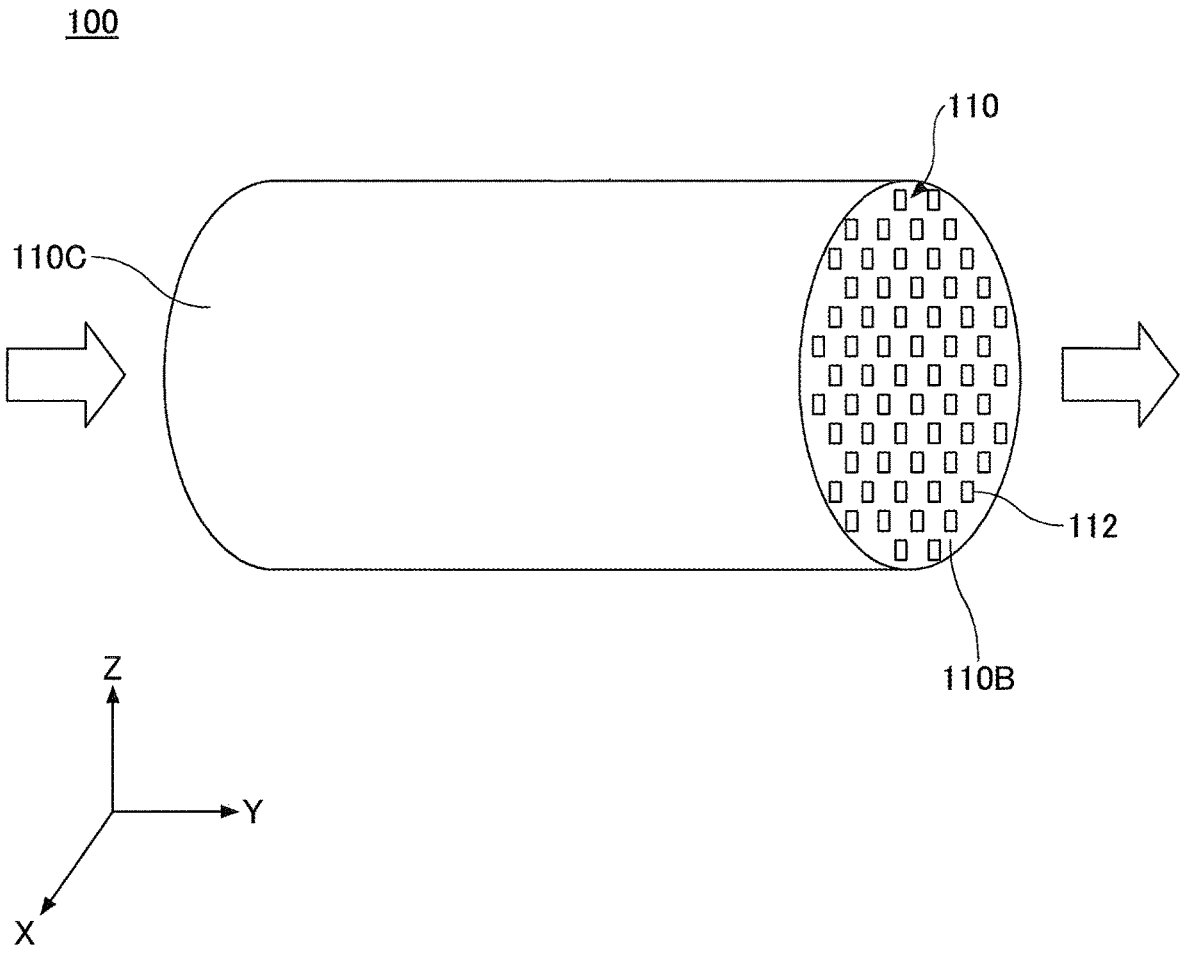
FIG. 2 is another diagram illustrating the filter 110 included in the exhaust gas treatment apparatus according to the first embodiment.

FIGS. 1 and 2 are diagrams illustrating a filter 110 included in an exhaust gas treatment apparatus according to a first embodiment.

The filter 110 indicates an example of a filter (DPF: Diesel Particulate Filter) configured to purify an exhaust gas of a diesel engine, and is inserted in series in an exhaust pipe discharging the exhaust gas of a diesel engine.

The filter 110 is housed inside a metal pipe. The pipe is a part of an exhaust pipe that discharges the exhaust gas of the diesel engine, and is an example of a cylindrical metal casing. The pipe is inserted in series between a first section and a second section of the exhaust pipe discharging the exhaust gas of the diesel engine. The first section is closer to the diesel engine than the second section.

The filter 110 is a columnar porous ceramic member and has multiple pores 111 and 112. The filter 110 may be made of, for example, ceramic made of silicon carbide (SiC).

The filter 110 further includes a first surface 110A (see FIG. 1), a second surface 110B (see FIG. 2), and a side surface 110C. Both the first surface 110A and the second surface 110B are circular, and the side surface 110C has a shape of a side surface of a columnar body (i.e., a rectangular shape curved in an annular shape).

The pores 111 extend along a Y axis direction from respective openings formed in the first surface 110A of the filter 110 toward the second surface 110B, and are closed immediately before the second surface 110B. The extending direction (i.e., Y-axis direction) of the pores 111 is equal to a direction in which a cylindrical central axis of the filter 110 extends.

The shape of a cross section perpendicular to the extending direction of a pore 111 is, for example, a square. The cross section perpendicular to the extending direction of a pore 111 is a cross section parallel to an XZ plane. In the XZ plan view, the multiple pores 111 are arranged at positions of white squares among the multiple white squares and multiple black squares arranged in a nested pattern (checkered pattern). The multiple pores 111 extend from the respective openings formed in the first surface 110A to positions immediately before the second surface 110B.

The shape of a cross section perpendicular to the extending direction of a pore 112 is, for example, a square. The cross section perpendicular to the extending direction of a pore 112 is a cross section parallel to an XZ plane. In the XZ plan view, the multiple pores 112 are arranged at positions of black squares among the multiple white squares and multiple black squares arranged in a nested pattern. The multiple pores 112 extend from the respective openings formed in the second surface 110B to positions immediately before the first surface 110A.

As illustrated above, the multiple pores 111 and the multiple pores 112 are arranged in a nested pattern, and are alternately arranged so as not to mutually overlap or contact three dimensionally.

An exhaust gas discharged from the first section of the exhaust pipe flows into the multiple pores 111. That is, the multiple pores 111 are located on an exhaust gas inflow side of the filter 110. Further, the multiple pores 112 discharge the purified exhaust gas to the second section of the exhaust pipe. That is, the multiple pores 112 are located on an exhaust gas outflow side of the filter 110.

The exhaust gas flowing into the multiple pores 111 passes through pores of the filter 110 between the multiple pores 111 and the multiple pores 112 and flows out of the multiple pores 112.

For example, the size of each pore 111 in the XZ planar view is 1 mm side length, which is the same size for the pores 112. An interval between the pores 111 and the pores 112 in an X axis direction and a Z axis direction is, for example, 300 μm.

Further, the diameter of the filter 110 in the XZ plan view and the length in a Y axis direction may be set to appropriate values according to the displacement or the use of the diesel engine using the exhaust gas treatment apparatus 100.

Figure 3:
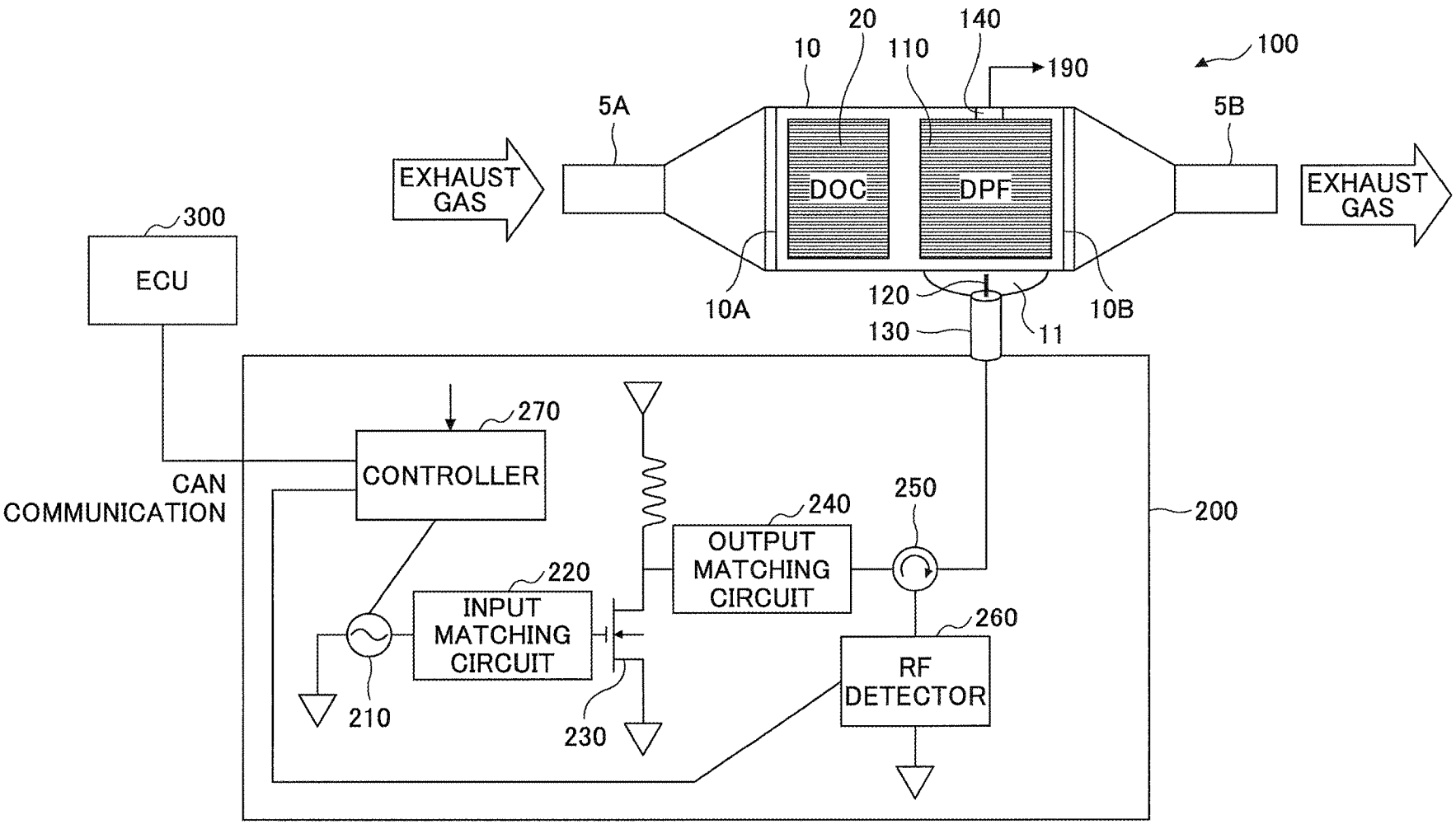
FIG. 3 is a diagram illustrating an exhaust gas treatment apparatus 100 including the filter 110 according to the embodiment.
Figure 4:
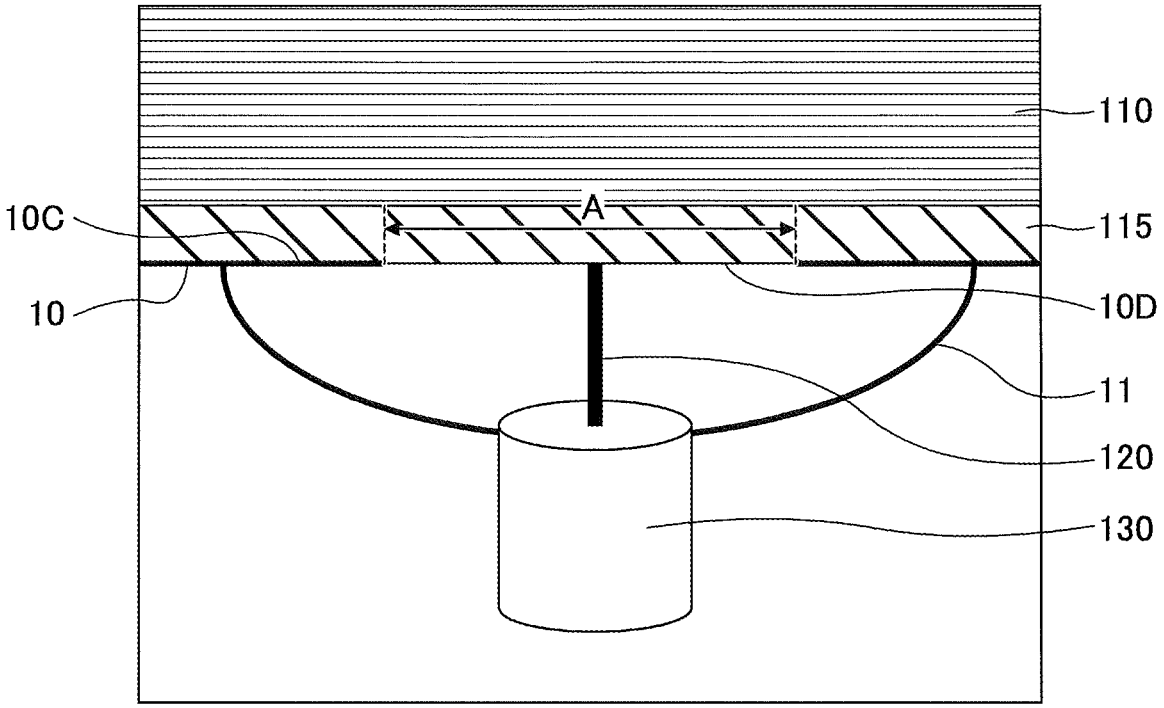
FIG. 4 is an enlarged diagram of a part of FIG. 3.

FIG. 3 is a diagram illustrating an exhaust gas treatment apparatus 100 including the filter 110 according to the embodiment. FIG. 4 is an enlarged diagram of a part of FIG. 3.

The exhaust gas treatment apparatus 100 includes a pipe 10, a diesel oxidation catalyst (DOC) 20, a filter (DPF) 110, an antenna 120, a coaxial cable 130, a temperature sensor 140, and an external device 200. FIG. 4 indicates an insulating material 115 provided around the filter 110.

The external device 200 includes an oscillator 210, an input matching circuit 220, a transistor 230, an output matching circuit 240, a circulator 250, a radio frequency (RF) detector 260, and a controller 270. In addition, an electronic control unit (ECU) 300 is connected to the controller 270.

Note that the antenna 120 and the oscillator 210 constitute a filter regeneration device. The filter regeneration device may further include the transistor 230. Further, the filter regeneration device may further include the temperature sensor 140, the transistor 230, and the controller 270.

In addition, the antenna 120 constitutes a filter plugging detection device. The filter plugging detection device may further include the controller 270. Further, the filter plugging detection device may further include the temperature sensor 140, the transistor 230, and the controller 270.

The pipe 10 is a part of an exhaust pipe that discharges the exhaust gas of the diesel engine, and is disposed between pipes 5A and 5B in front and rear sections. The pipe 10 is thicker than the pipes 5A and 5B and has a convex portion 11 on a part of an outer periphery of the pipe 10. The convex portion 11 corresponds to a part of the outer periphery of the pipe 10 that protrudes in a hemispherical shape. A filter 110 is disposed inside the pipe 10.

The pipe 10 further includes metal plates 10A and 10B. The metallic plates 10A and 10B are examples of a first metal plate and a second metal plate, respectively. The metal plate 10A is provided on the inflow side (left side in the drawing) of the filter 110 and has vent holes through which an exhaust gas passes. The metal plate 10B is provided on the outflow side (right side in the drawing) of the filter 110 and has vent holes through which an exhaust gas passes. The vent holes of the metal plates 10A and 10B may be designed so as to minimize the resistance to the flow of the exhaust gas. The vent holes of the metal plates 10A and 10B may be, for example, mesh-shaped.

Such metal plates 10A and 10B are provided such that microwaves radiated from the antenna 120 are confined in a section between the metal plate 10A and the metal plate 10B.

The DOC 20, the filter 110, and the temperature sensor 140 are housed inside the pipe 10, and the antenna 120 is housed inside the convex portion 11. A core wire of the coaxial cable 130 is connected to the antenna 120 from the outside of the convex portion 11, and a shielded wire of the coaxial cable 130 is connected to the pipe 10 (body ground).

The DOC 20 is provided on an upstream side of the filter 110, and oxidizes carbon monoxide (CO) and hydrocarbon (HC) in the exhaust gas and discharges the oxidized CO and HC to the filter 110 acting as a DPF. The filter 110 has a configuration as described with reference to FIGS. 1 and 2, and is configured to remove the soot contained in the exhaust gas.

For example, the antenna 120 is a monopole antenna, which is provided inside the convex portion 11 and radiates a microwave to the filter 110. The antenna 120 is an example of a microwave radiator and is also an example of a detector.

The microwave is used for measuring the amount of soot deposited on the filter 110 (hereinafter may also be called "soot deposition amount"), and for heating and incineration of soot. Note that the amount (deposition amount) of soot deposited on the filter 110 is referred to as a degree of plugging of the filter 110.

A partition wall 10C is disposed between the space inside the convex portion 11 and the space inside the pipe 10. The partition wall 10C has a configuration such that a cylindrical wall of the pipe 10 extends to the inside of the convex portion 11, and is provided with a communication port 10D at the center of the partition wall 10C. The communication port 10D is a circular hole, and its diameter A is set to be equal to or greater than half (λ/2) of an electrical length (λ) of a wavelength of the microwave. The diameter A is set as above because the microwave radiated from the antenna 120 is efficiently radiated into the pipe 10 from the convex portion 11.

The coaxial cable 130 is connected to the external device 200, and transmits the microwave generated by the oscillator 210 to the antenna 120. The frequency of the microwave is, for example, 2.45 GHz.

The temperature sensor 140 is disposed on an outer peripheral portion of the filter 110 and measures the temperature of the filter 110. The temperature sensor 140 is an example of a temperature detector. The temperature sensor 140 may, for example, be a thermocouple. A signal representing the temperature of the filter 110 measured by the temperature sensor 140 is input to the controller 270 of the external device 200; the signal is used for determining the output of the microwave for heating and incinerating the soot.

The oscillator 210 is, for example, a voltage-controlled oscillator (VCO); the oscillator 210 generates and outputs a microwave of 2.45 GHz. An input matching circuit 220, a transistor 230, a resistor R, an output matching circuit 240, and a circulator 250 are connected to the output side of the oscillator 210. A coaxial cable 130 is connected to the output side of the circulator 250. The oscillator 210 and the transistor 230 are examples of a microwave generator.

The gate of the transistor 230 is connected to the oscillator 210 via the input matching circuit 220, the source of the transistor 230 is grounded, and the drain of the transistor 230 is connected to one end of the resistor R and one end of the output matching circuit 240. The other end of the resistor R is connected to a power supply of a predetermined voltage, and the other end of the output matching circuit 240 is connected to the circulator 250. In this configuration, by providing the input matching circuit 220, the resistor R, and the output matching circuit 240 before and after the transistor 230, the impedance is adjusted.

The transistor 230 used may, for example, be a high electron mobility transistor made of gallium nitride (GaN-HEMT). The GaN-HEMT is suitable for a high-power power amplifier for amplifying a microwave, and may amplify the microwave generated by the oscillator 210 into a high-power microwave.

The circulator 250 is a three-port circuit used as a switch; the circulator 250 is configured to switch a connection destination of the coaxial cable 130 to one of the output matching circuit 240 and the RF detector 260.

When measuring the amount (deposition amount) of soot deposited on the filter 110, the RF detector 260 receives a signal representing intensity of the microwave received by the antenna 120, and detects the intensity of the microwave received by the antenna 120 based on the intensity of the input signal. The RF detector 260 outputs a signal representing the detected intensity of the microwave to the controller 270.

The controller 270 performs a process of measuring the amount (deposition amount) of soot deposited on the filter 110, a regeneration process of the filter 110, and the like based on instructions input from the ECU 300. The controller 270 and the ECU 300 are connected by a controller area network (CAN).

Specifically, the ECU 300 performs the following process via the controller 270.

In order to measure the amount (deposition amount) of soot deposited on the filter 110, the ECU 300 causes the oscillator 210 to generate a predetermined output microwave to the controller 270. Further, after the oscillator 210 generates a microwave and radiates the generated microwave from the antenna 120 to the filter 110, the ECU 300 receives a signal representing the intensity of the microwave as detected by the RF detector 260 via the controller 270, and measures the amount (deposition amount) of soot deposited on the filter 110.

The output of the microwave used for measurement may be determined in advance by experiment, simulation or the like, and the deposition amount of soot may be obtained based on a ratio of the intensity of the microwave received by the antenna 120 to the intensity of the microwave output from the antenna 120 to the filter 110. As an example of the intensity of the microwave, microwave electric field intensity, output or the like may be used.

Further, when the ratio between the intensity of the microwave received by the antenna 120 to the intensity of the microwave output from the antenna 120 to the filter 110 is determined in advance by experiment, simulation or the like, the soot deposition amount may be obtained.

The ECU 300 receives a signal representing the temperature of the filter 110 measured by the temperature sensor 140 via the controller 270. The ECU 300 determines the intensity and the radiation time of the microwave for heating/incinerating the soot (regenerating) based on the signal representing the temperature of the filter 110 and the soot deposition amount thus obtained.

The intensity and the radiation time of the microwave for performing the regeneration process of the filter 110 may be determined in advance by experiment, simulation or the like according to the soot deposition amount. The more the soot deposition amount, the higher the microwave intensity and the longer the radiation time. As the soot deposition amount becomes less, the intensity of the microwave and the irradiation time need to be reduced.

Further, the temperature of the filter 110 before heating differs according to a driving state (speed, accelerator position, engine speed of the internal combustion engine, ambient temperature, etc.). When the temperature of the filter 110 is high, the intensity of the microwave for heating the filter 110 may be low and the radiation time may be short. Further, when the temperature of the filter 110 is low, the intensity of the microwave for heating the filter 110 may preferably be high, and the radiation time may preferably be long.

Accordingly, when the soot deposited on the filter 110 is heated, the ECU 300 adjusts the intensity and the radiation time of the microwave according to the soot deposition amount and the temperature of the filter 110 via the controller 270.

Figure 5:
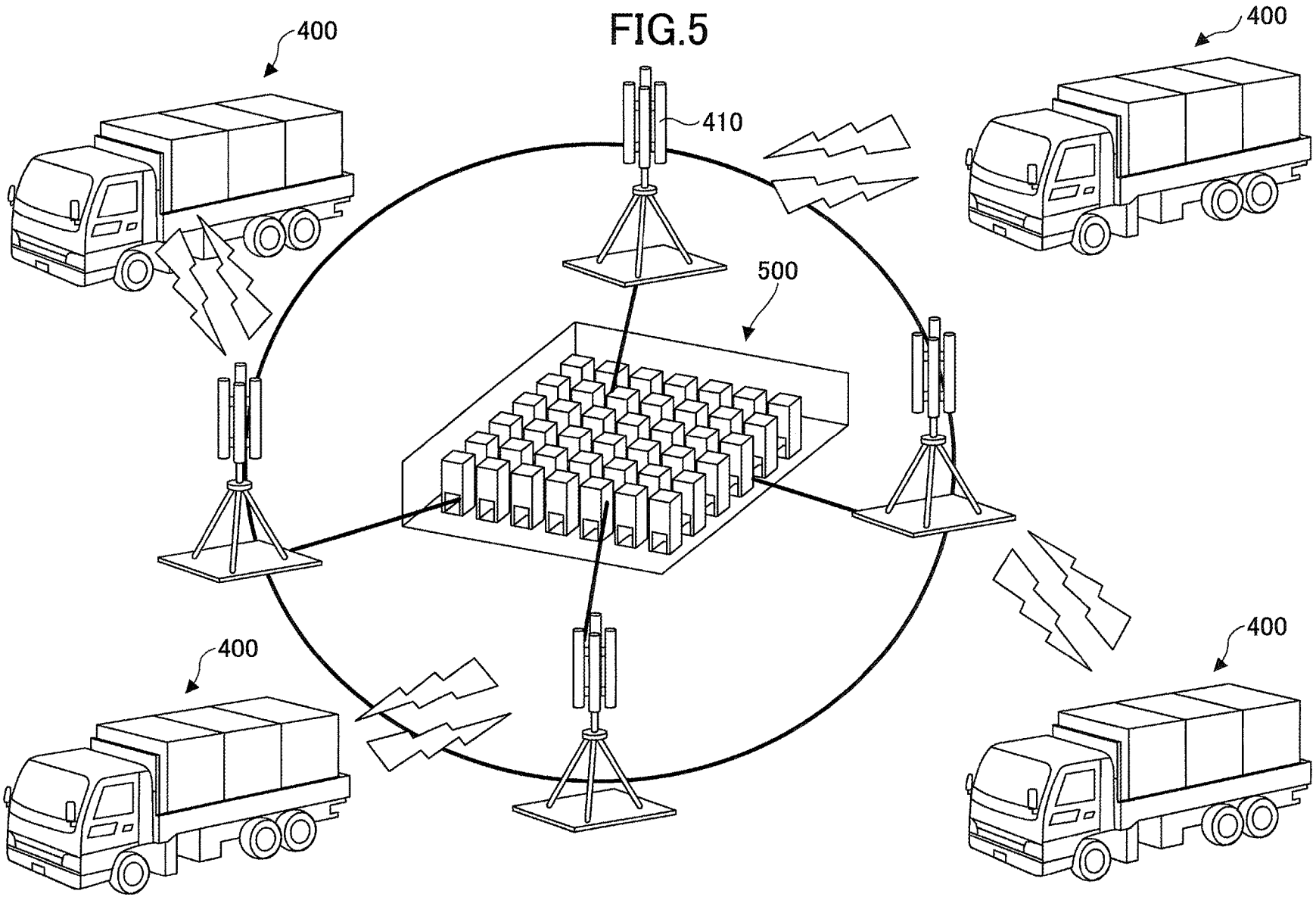
FIG. 5 is a diagram illustrating an operation management system including an information processing apparatus 500 of a data center.

FIG. 5 is a diagram illustrating an operation management system including an information processing apparatus 500 of a data center. The information processing apparatus 500 of the data center is configured to perform radio communication with one or more vehicles 400 via a corresponding radio base station 410. The radio base station 410 is, for example, a base station (relay station) for radio communication using a mobile phone line. The information processing apparatus 500 of such a data center may be a server, or may be a virtual machine (e.g., a cloud computer) implemented by multiple servers or computers or the like.

Figure 6:
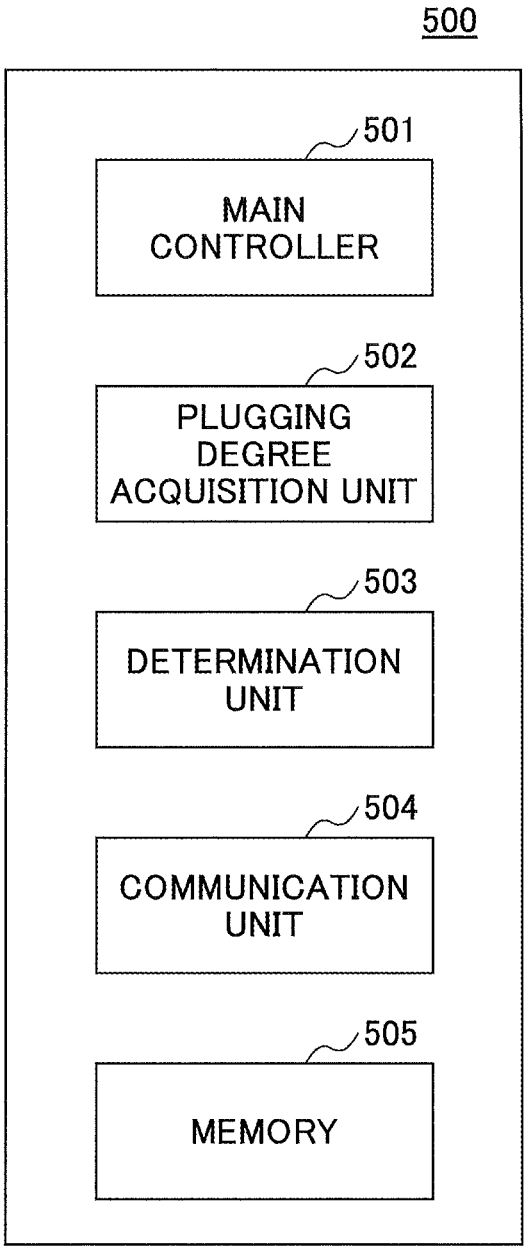
FIG. 6 is a diagram illustrating a configuration of the information processing apparatus 500.

FIG. 6 is a diagram illustrating a configuration of the information processing apparatus 500. The information processing apparatus 500 includes a main controller 501, a plugging degree acquisition unit 502, a determination unit 503, a communication unit 504, and a memory 505.

The main controller 501 is a processor configured to control over processes of the information processing apparatus 500. The main controller 501 communicates with the vehicle 400 and transmits an instruction signal for instructing the filter 110 to execute a regeneration process of the filter 110 to the ECU 300 of the vehicle 400 via the communication unit 504 in accordance with the deposition amount of soot, the type of loading, the traveled route, etc. The specific process executed by the main controller 501 will be described later with reference to a flowchart of FIG. 8.

The plugging degree acquisition unit 502 is configured to acquire a signal indicating the degree of plugging detected by the antenna 120, which is used as a sensor for detecting the plugging degree, from the ECU 300 of the vehicle 400 via the communication unit 504 by radio communication. The plugging degree is represented by the intensity of a microwave received by the antenna 120.

The determination unit 503 is configured to calculate a soot deposition amount of the filter 110 based on a signal (a signal representing the intensity of the received microwave) representing the degree of plugging acquired by the plugging degree acquisition unit 502. The soot deposition amount of the filter 110 may be obtained based on a ratio of the intensity of the microwave received by the antenna 120 to the intensity of the microwave output from the antenna 120 to the filter 110.

The determination unit 503 is configured to hold, in advance, data representing the intensity of the microwave output from the antenna 120 to the filter 110, and to obtain the ratio between the held data (i.e., the intensity of the microwave output from the antenna 120 to the filter 110) and the plugging degree (i.e., the intensity of the microwave received by the antenna 120) so as to calculate the soot deposition amount of the filter 110.

As the ratio of the intensity of the microwave received by the antenna 120 to the intensity of the microwave output from the antenna 120 to the filter 110 is smaller, the soot deposition amount will be smaller; as the ratio is larger, the soot deposition amount will be larger. This is because when the soot deposition amount is small, the microwave is hardly reflected by the filter 110, and when the soot deposition amount is large, the degree of reflection of the microwave by the filter 110 increases.

Note that by determining a relationship between the ratio of the intensity of the microwave received by the antenna 120 to the intensity of the microwave output from the antenna 120 to the filter 110 and the deposition amount of the soot in advance through experiments or simulations or the like, a specific soot deposition amount may be obtained from the ratio of the intensity of the microwave received by the antenna 120 to the intensity of the microwave output from the antenna 120 to the filter 110.

The determination unit 503 is configured to determine whether the calculated plugging degree is equal to or higher than a predetermined threshold degree. When the determination unit 503 determines that the plugging degree is equal to or higher than the predetermined threshold degree, the determination unit 503 causes the main controller 501 to execute a process of transmitting an instruction signal to the ECU 300 of the vehicle 400 so as to cause the ECU 300 to execute a regenerating process of the filter 110.

The communication unit 504 is configured to perform radio communication with the ECU 300 of the vehicle 400 by radio communication using a mobile phone line. The communication unit 504 is a modem. Further, the memory 505 is configured to store various data and the like necessary for processes performed in the data center.

Figure 7:
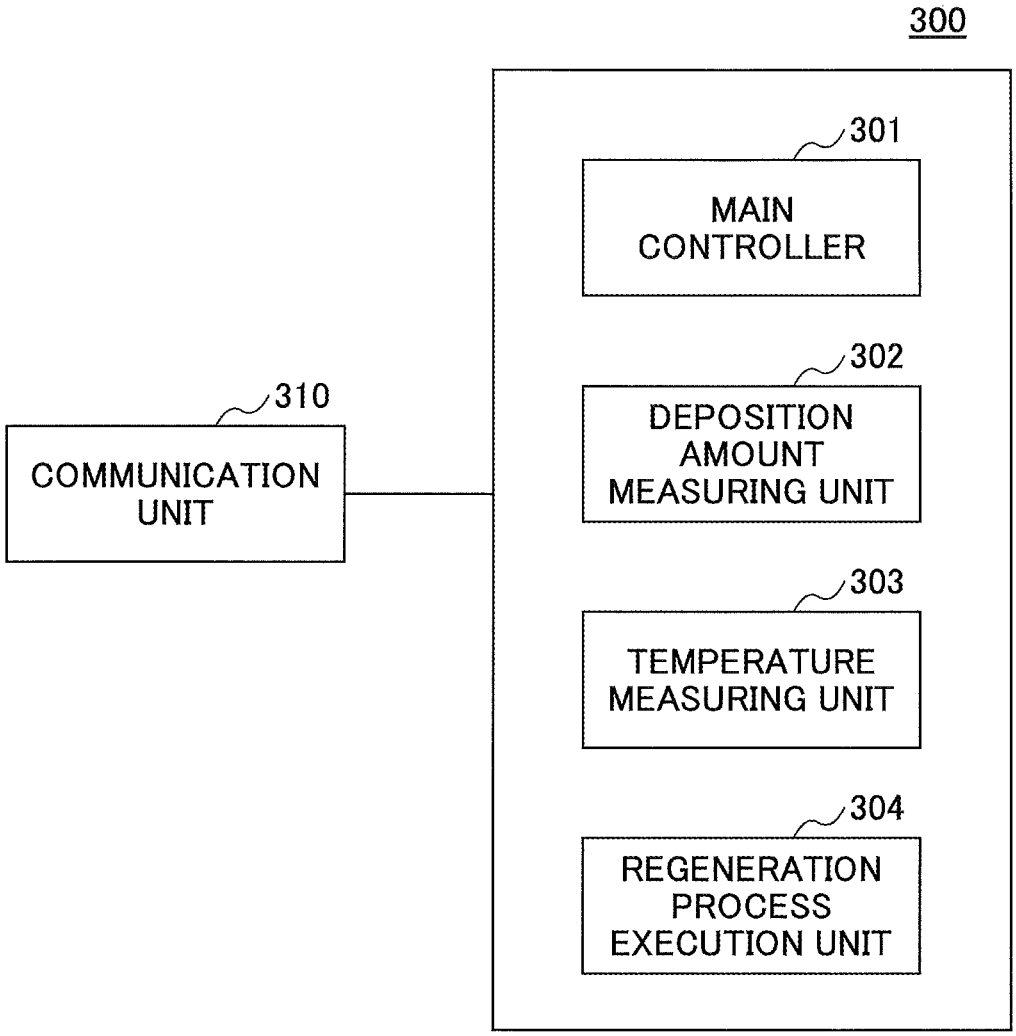
FIG. 7 is a diagram illustrating a configuration of an ECU 300.

FIG. 7 is a diagram illustrating a configuration of the ECU 300.

The ECU 300 includes a main controller 301, a deposition amount measuring unit 302, a temperature measuring unit 303, and a regeneration process execution unit 304. The ECU 300 is connected to the communication unit 310. The communication unit 310 is a modem installed in the vehicle 400 and is configured to perform radio communication with the communication unit 504 of the information processing apparatus 500 by radio communication using a mobile phone line.

The main controller 301 is a processor configured to control the processes of the ECU 300, and to execute various processes via the controller 270. The specific process executed by the main controller 301 will be described later with reference to a flowchart of FIG. 9.

In accordance with instructions from the information processing apparatus 500, the deposition amount measuring unit 302 is configured to radiate a measurement microwave from the antenna 120 to the filter 110 via the controller 270, and to acquire the intensity of the microwave received by the antenna 120. The deposition amount measuring unit 302 is configured to transmit a signal representing the acquired intensity of the microwave to the information processing apparatus 500. The signal representing the intensity of the microwave is used in calculating the amount of soot deposited in the filter 110 (degree of plugging of the filter 110).

The temperature measuring unit 303 is configured to acquire the temperature of the filter 110 measured by the temperature sensor 140 via the controller 270 in accordance with an instruction from the information processing apparatus 500. A signal representing the temperature measured by the temperature sensor 140 is input to the temperature measuring unit 303 via the controller 270.

The regeneration process execution unit 304 is configured to perform a regeneration process of the filter 110 via the controller 270 in response to the instruction from the information processing apparatus 500. The regeneration process execution unit 304 determines the intensity and the radiation time of the microwave for heating/incinerating the soot (regenerating) based on the signal representing the temperature of the filter 110 and the obtained soot deposition amount.

Figure 8:
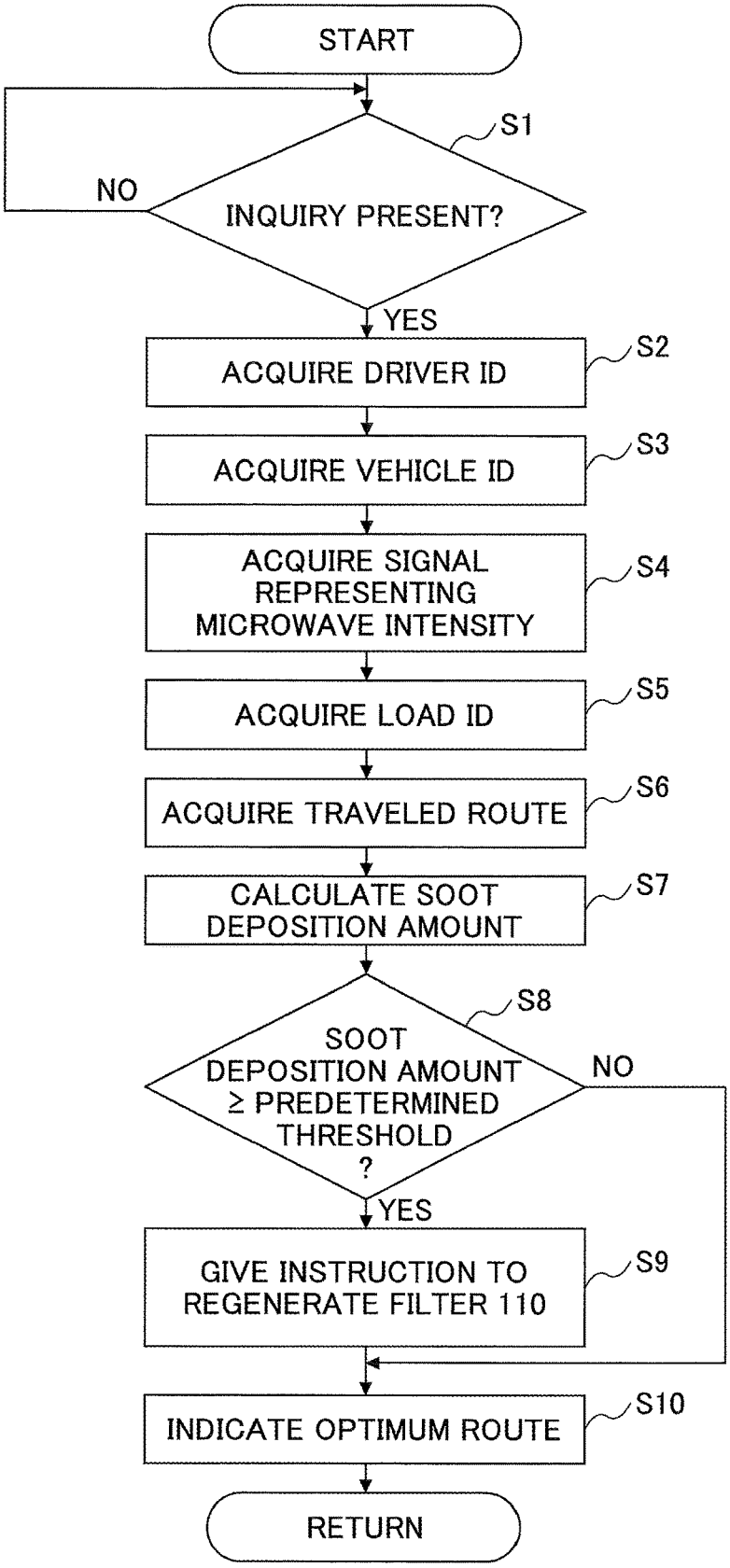
FIG. 8 is a flowchart illustrating a process executed by the information processing apparatus 500.

FIG. 8 is a flowchart illustrating a process executed by an information processing apparatus 500. This flow is executed by the main controller 501, the plugging degree acquisition unit 502, the determination unit 503, and the communication unit 504.

On starting the flow (start), the main controller 501 checks the presence or absence of an inquiry from the vehicle 400 (step S1). The inquiry from the vehicle 400 is made to the information processing apparatus 500 when the ECU 300 of the vehicle 400 determines whether a regeneration process is necessary to execute. The process of step S1 is repeated until the main controller 501 detects the presence of an inquiry.

The main controller 501 acquires a driver ID (Identification) (step S2). When the vehicle 400 makes an inquiry to the information processing apparatus 500, the driver ID is transmitted from the ECU 300 of the vehicle 400 to the information processing apparatus 500. The main controller 501 reads data representing an operation pattern associated with the driver ID in a database.

The main controller 501 acquires a vehicle ID (Identification) (step S2). When the vehicle 400 makes an inquiry to the information processing apparatus 500, the vehicle ID is transmitted from the ECU 300 of the vehicle 400 to the information processing apparatus 500.

The plugging degree acquisition unit 502 acquires a signal representing the intensity of a microwave transmitted from the vehicle 400 (step S4). The signal representing the intensity of the microwave is a signal representing the degree of plugging of the filter 110, which is used in calculating the amount of soot deposited in the filter 110.

The main controller 501 acquires a load ID (step S5). When the vehicle 400 makes an inquiry to the information processing apparatus 500, the load ID is transmitted from the ECU 300 of the vehicle 400 to the information processing apparatus 500. The load ID represents a type of a package loaded by the vehicle 400.

The main controller 501 acquires a traveled route (step S6). The traveled route is a history of roads or routes on which the vehicle 400 subject to being processed in the flow illustrated in FIG. 8 has traveled by the time of inquiry. Such a traveled route may be obtained by, for example, periodically conducting communication between the ECU 300 of the vehicle 400 and the information processing apparatus 500 to acquire, from a navigation system of the vehicle 400, data representing the roads or routes on which the vehicle 400 has been traveling.

The determination unit 503 calculates the soot deposition amount of the filter 110 (step S7). The determination unit 503 calculates the soot deposition amount of the filter 110 based on a signal representing the intensity of the microwave.

The determination unit 503 determines whether the soot deposition amount is equal to or greater than a predetermined threshold (step S8). The predetermined threshold value may be stored in advance in a memory 505 by the information processing apparatus 500.

When determining that the soot deposition amount is equal to or greater than the predetermined threshold value (step S8: YES), the main controller 501 instructs the ECU 300 of the vehicle 400 to perform a regeneration process of the filter 110 (step S9).

The main controller 501 indicates an optimum route (step S10). The optimum route indicates the most suitable route for performing a regeneration process among the routes to a current destination that may be taken by the vehicle 400 when the vehicle 400 performs the regeneration process. A route suitable for performing the regeneration process may, for example, be a route that facilitates continuous traveling of the vehicle 400 at a constant speed such as an expressway or freeway.

Upon completion of the above process, the main controller 501 returns to step S1 of the flow. In order to communicate with multiple vehicles 400, the information processing apparatus 500 executes the flow illustrated in FIG. 8 each time an inquiry is made from any one of the vehicles 400.

Figure 9:
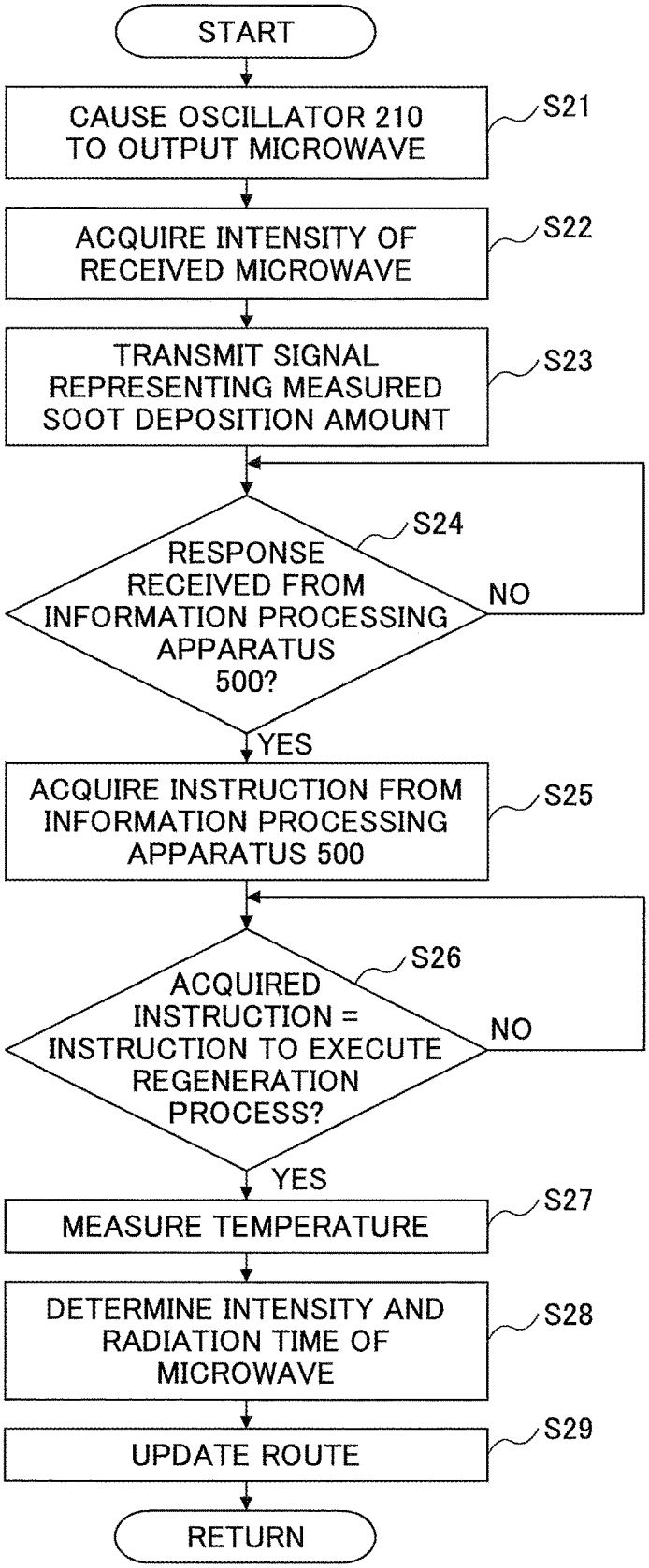
FIG. 9 is a flowchart illustrating a process executed by the ECU 300.

FIG. 9 is a flowchart illustrating a process executed by the ECU 300. The following process is executed by the ECU 300 via the controller 270.

The main controller 301 starts the process at a predetermined timing and causes the oscillator 210 for measuring the deposition amount to output a microwave (step S21). The predetermined timing is, for example, when the travel distance of the vehicle 400 reaches a predetermined distance after the previous regeneration process, or when the fuel injection amount reaches a predetermined amount, or the like. Note that since the periodical regeneration process of the filter 110 may be conducted only at an approximate level, the method of taking the predetermined timing may be a method other than those described above.

The deposition amount measuring unit 302 irradiates the filter 110 with the microwave for measuring the deposition amount and acquires the intensity of the microwave received from the antenna 120 (step S22). The signal representing the intensity of the microwave is a signal representing the degree of plugging of the filter 110, which is used in calculating the amount of soot deposited in the filter 110.

The main controller 301 transmits a signal representing the measured soot deposition amount to the information processing apparatus 500 of the data center (step S23).

The main controller 301 determines whether a response is received from the information processing apparatus 500 of the data center (step S24). The process of step S24 is repeatedly executed until a response is received from the information processing apparatus 500.

The main controller 301 acquires an instruction from the information processing apparatus 500 of the data center (step S25).

The main controller 301 determines whether the instruction acquired in step S25 is an instruction to execute the regeneration process (step S26). The process of step S26 is repeatedly executed until the main controller 301 determines that the acquired instruction is the instruction to execute the regeneration process.

The temperature measuring unit 303 measures the temperature of the filter 110 using the temperature sensor 140 (step S27).

The regeneration process execution unit 304 determines the intensity and the radiation time of the microwave for heating/incinerating the soot (regenerating) based on the signal representing the temperature of the filter 110 and the obtained soot deposition amount (step S28).

The main controller 301 updates the route (step S29).

Upon completion of the above processes, the main controller 301 returns to step S1 of the flow.

As described above, according to the embodiment, the microwave is directly radiated from the antenna 120 disposed inside the convex portion 11 of the pipe 10 to the filter 110 disposed inside the pipe 10, which may simplify the structure of the exhaust gas treatment apparatus 100. The exhaust gas treatment apparatus 100 includes a filter regeneration device and a filter plugging detection device, and a filter plugging determination method is performed using the exhaust gas treatment apparatus 100.

The disclosed embodiments may provide a filter regeneration device with a simple structure, a filter plugging detection device, the exhaust gas treatment apparatus 100, and a filter plugging determination method.

In addition, since the antenna 120 is disposed inside the convex portion 11 where the outer peripheral portion of the pipe 10 protrudes outward, the antenna 120 deviates from the flow path of the exhaust gas. As a result, the antenna 120 will not interfere with the flow of the exhaust gas, which makes the antenna 120 less susceptible to being heated by the exhaust gas, less susceptible to breakage, or the like, thereby extending the life of the antenna 120.

Further, since the soot deposition amount may be obtained based on the ratio of the intensity of the microwave received by the antenna 120 to the intensity of the microwave output from the antenna 120 to the filter 110, the intensity of the microwave may be determined according to the soot deposition amount at the time of regenerating filter 110.

In addition, the temperature of the filter 110 may be measured by the temperature sensor 140, and the intensity of the microwave at the time of regenerating the filter 110 may be determined according to the temperature of the filter 110. In order to simplify the structure of the exhaust gas treatment apparatus 100, the temperature sensor 140 may be omitted from the structure.

Further, since a GaN-HEMT is used as the transistor 230, the microwave generated in the oscillator 210 may be amplified to a high-power microwave.

The method implemented by the flows of FIG. 8 and FIG. 9 is a filter plugging determination method. According to the above description, the determination unit 503 of the information processing apparatus 500 determines whether the soot deposition amount is equal to or greater than the predetermined threshold value. However, the ECU 300 may compare the soot deposition amount with a predetermined threshold value to make such a determination.

Further, according to the above description, in order to measure the soot deposition amount, a configuration of emitting microwaves from the antenna 120 and receiving microwaves reflected by the filter 110 has been proposed. Alternatively, another antenna may be provided on the side opposite to the antenna 120 with the filter 110 to be interposed between the two antennas, and the microwave radiated from the antenna 120 and transmitted through the filter 110 may be received by another antenna. In this case, as for a higher the intensity of the microwave received, the soot deposition amount will be smaller; and, as for a lower the received microwave intensity, the soot deposition amount will be larger.

According to the above description, the antenna 120 is a monopole antenna. However, the antenna 120 may be an antenna other than the monopole antenna such as a dipole antenna or a patch antenna.

Further, the shape of the convex portion 11 on which the antenna 120 is disposed is not limited to a hemispherical shape, and may be any shape insofar as the shape does not interfere with the radiation and reception of microwaves.

According to an aspect of the embodiments, a filter plugging determination method for determining a plugging degree of a ceramic filter (110) based on intensity of a microwave detected by a filter plugging detection device is disclosed. The filter plugging detection device includes a microwave radiator (120) configured to radiate a microwave and disposed to be oriented in a direction toward a ceramic filter (110) configured to purify exhaust gas of an internal combustion engine, the ceramic filter (110) being disposed in a cylindrical portion of a metallic case (10) having the cylindrical portion and having a protruding portion (11) protruding toward an outside of the cylindrical portion, the microwave radiator (120) being disposed inside the protruding portion (11), and a detector (120) configured to detect the microwave that is radiated by the microwave radiator (120) and passes through the ceramic filter (110) or that is radiated by the microwave radiator (120) and is reflected by the ceramic filter (110). The filter plugging determination method includes determining the plugging degree of the ceramic filter (110) based on the intensity of the microwave detected by the detector (120) to be high as the intensity of the microwave passing through the ceramic filter (110) becomes lower or the intensity of the microwave reflected by the ceramic filter (110) becomes higher, and determining the plugging degree to be low as the intensity of the microwave passing through the ceramic filter (110) becomes higher or the intensity of the microwave reflected by the ceramic filter (110) becomes lower.

The disclosed embodiments may be able to provide a filter regeneration device with a simple structure, a filter plugging detection device, an exhaust gas treatment apparatus, and a filter plugging determination method.

Although the filter regeneration device, the filter plugging detection device, the exhaust gas treatment apparatus, and the filter plugging determination method of the exemplary embodiments of the present invention have been described above, the present invention is not limited to the specifically disclosed embodiment, and various modifications and changes may be possible without departing from the scope of the claims.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. A filter regeneration device comprising:

an antenna configured to radiate a microwave and disposed to be oriented in a direction toward a ceramic filter configured to purify exhaust gas of an internal combustion engine, the ceramic filter being disposed in a cylindrical portion of a metallic case having the cylindrical portion and having a protruding portion protruding toward an outside of the cylindrical portion of the metallic case, the antenna being disposed inside the protruding portion; and an oscillator configured to generate the microwave radiated from the antenna toward the ceramic filter, wherein the antenna, disposed inside the protruding portion, directly radiates the microwave to the ceramic filter via a communication port provided on a partition wall between the protruding portion and the cylindrical portion, and wherein a diameter of the communication port is equal to or greater than half of an electrical length of a wavelength of the microwave.

2. The filter regeneration device as claimed in claim 1, wherein the oscillator includes a high electron mobility transistor made of gallium nitride.

3. The filter regeneration device as claimed in claim 1, further comprising:

a temperature detector disposed on an outer circumference of the ceramic filter and configured to measure a temperature of the ceramic filter; and a processor configured to control output of the microwave generated by the oscillator, wherein the processor lowers the output of the microwave generated by the oscillator as the temperature detected by the temperature detector becomes higher, and raises the output of the microwave generated by the oscillator as the temperature detected by the temperature detector becomes lower.

4. A filter plugging detection device comprising:

an antenna configured to radiate a microwave and disposed to be oriented in a direction toward a ceramic filter configured to purify exhaust gas of an internal combustion engine, the ceramic filter being disposed in a cylindrical portion of a metallic case having the cylindrical portion and having a protruding portion protruding toward an outside of the cylindrical portion, the antenna being disposed inside the protruding portion;

wherein the antenna is configured to detect the microwave that is radiated by the antenna and passes through the ceramic filter or that is radiated by the antenna and is reflected by the ceramic filter, wherein the antenna, disposed inside the protruding portion, directly radiates the microwave to the ceramic filter via a communication port provided on a partition wall between the protruding portion and the cylindrical portion, and wherein a diameter of the communication port is equal to or greater than half of an electrical length of a wavelength of the microwave.

5. The filter plugging detection device as claimed in claim 4, further comprising:

a processor configured to determine a plugging degree of the ceramic filter based on intensity of the microwave detected by the antenna.

6. The filter plugging detection device as claimed in claim 4, further comprising:

a temperature detector configured to measure a temperature of the ceramic filter and disposed on an outer circumference of the ceramic filter.

7. An exhaust gas treatment apparatus comprising:

a ceramic filter configured to purify exhaust gas of an internal combustion engine, the ceramic filter being disposed in a cylindrical portion of a metallic case having the cylindrical portion and having a protruding portion protruding toward an outside of the cylindrical portion;

an antenna configured to radiate a microwave toward the ceramic filter and disposed inside the protruding portion of the metallic case; and an oscillator configured to generate the microwave radiated from the antenna toward the ceramic filter, wherein the antenna, disposed inside the protruding portion, directly radiates the microwave to the ceramic filter via a communication port provided on a partition wall between the protruding portion and the cylindrical portion, and wherein a diameter of the communication port is equal to or greater than half of an electrical length of a wavelength of the microwave.

8. The exhaust gas treatment apparatus as claimed in claim 7, wherein the oscillator includes a high electron mobility transistor made of gallium nitride.

9. The exhaust gas treatment apparatus as claimed in claim 7, further comprising:

a temperature detector disposed on an outer circumference of the ceramic filter and configured to measure a temperature of the ceramic filter; and a processor configured to control output of the microwave generated by the oscillator, wherein the processor lowers the output of the microwave generated by the oscillator as the temperature detected by the temperature detector becomes higher, and raises the output of the microwave generated by the oscillator as the temperature detected by the temperature detector becomes lower.

10. The exhaust gas treatment apparatus as claimed in claim 7, wherein the protruding portion is disposed, with respect to a flow path direction in which the exhaust gas flows through the ceramic filter, on an outer peripheral portion of the ceramic filter at an interval between an inflow end through which an exhaust gas flows into the ceramic filter and an exhaust end from which the exhaust gas is exhausted from the ceramic filter.

11. The exhaust gas treatment apparatus as claimed in claim 7, further comprising:

a first metal plate disposed on an inflow side of the ceramic filter inside the metal casing and having first vent holes through which the exhaust gas flowing into the ceramic filter passes; and a second metal plate disposed on an exhaust side of the ceramic filter inside the metal casing and having second vent holes through which the exhaust gas flowing out of the ceramic filter passes.

12. The exhaust gas treatment apparatus as claimed in claim 7, further comprising:

a partition wall partitioning an interval between the protruding portion and the cylindrical portion, the partition wall having an opening configured to connect the protruding portion and the cylindrical portion.

* * * * *